US011248894B2

(12) United States Patent
Loehken

(10) Patent No.: US 11,248,894 B2
(45) Date of Patent: Feb. 15, 2022

(54) HIGH SHOT DENSITY CHARGE HOLDER FOR PERFORATING GUN

(71) Applicant: DynaEnergetics Europe GmbH, Troisdorf (DE)

(72) Inventor: Joern Loehken, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/761,864

(22) PCT Filed: Nov. 6, 2018

(86) PCT No.: PCT/EP2018/080298

§ 371 (c)(1),
(2) Date: May 6, 2020

(87) PCT Pub. No.: WO2019/091963

PCT Pub. Date: May 16, 2019

(65) Prior Publication Data

US 2020/0263968 A1 Aug. 20, 2020

Related U.S. Application Data

(60) Provisional application No. 62/585,125, filed on Nov. 13, 2017.

(51) Int. Cl.
*F42D 1/02* (2006.01)
*F42D 1/04* (2006.01)
(Continued)

(52) U.S. Cl.
CPC ..... *F42D 1/02* (2013.01); *E21B 43/117* (2013.01); *E21B 43/1185* (2013.01); *F42D 1/043* (2013.01)

(58) Field of Classification Search
CPC ..... F42D 1/02; F42D 1/043; E21B 43/117; E21B 43/116; E21B 43/11; E21B 43/1185; E21B 43/118
(Continued)

(56) References Cited

U.S. PATENT DOCUMENTS 2,682,834 A 7/1954 Church et al.
2,873,676 A * 2/1959 Caldwell ..... E21B 43/117 175/4.6
(Continued)

FOREIGN PATENT DOCUMENTS

EP 2416108 A1 2/2012
FR 2866701 A1 8/2005
(Continued)

OTHER PUBLICATIONS

International Searching Authority, International Search Report and Written Opinion of PCT/EP2018/080298, dated Dec. 12, 2018, 17 pgs.

*Primary Examiner* — Jonathan C Weber
(74) *Attorney, Agent, or Firm* — Moyles IP, LLC

(57) ABSTRACT

A holder for shaped charges is shown and described. The charge holder facilitates a high shot density for use with a perforating gun. The shaped charges are arranged to direct explosive force axially outward from a perforating gun. The plurality of radially spaced charges are designed to result in an annular ring of blast effect in any metal tubing associated with the oil/gas extraction operation as well as any concrete conduits in which the tubing is disposed.

20 Claims, 6 Drawing Sheets

(51) Int. Cl.
*E21B 43/117* (2006.01)
*E21B 43/1185* (2006.01)

(58) Field of Classification Search
USPC ..... 89/1.15; 102/306, 307, 308, 309, 310, 102/318, 320, 321; 175/4.55, 4.6
See application file for complete search history.

(56) References Cited

U.S. PATENT DOCUMENTS 3,013,491 A 12/1961 Poulter
3,565,188 A * 2/1971 Hakala ..... E21B 43/117 175/4.6
3,589,453 A * 6/1971 Venghiattis ..... E21B 43/117 175/4.6
4,140,188 A 2/1979 Vann
4,160,412 A 7/1979 Snyer et al.
4,354,433 A 10/1982 Owen
4,598,775 A 7/1986 Vann et al.
4,657,089 A 4/1987 Stout
4,724,105 A * 2/1988 Owen ..... B26F 3/04 102/307
4,753,170 A 6/1988 Regalbuto et al.
5,253,585 A 10/1993 Hudak et al.
5,673,760 A 10/1997 Brooks et al.
5,829,538 A 11/1998 Wesson et al.
6,026,750 A * 2/2000 Nelson ..... F42B 1/02 102/307
6,505,559 B1 1/2003 Joslin et al.
6,557,636 B2 5/2003 Cernocky et al.
7,104,326 B2 9/2006 Grattan et al.
7,146,913 B2 * 12/2006 Bell ..... E21B 29/02 102/322
7,661,367 B2 * 2/2010 Yang ..... F42B 3/08 102/306
7,942,098 B2 5/2011 Han et al.
8,091,477 B2 1/2012 Brooks et al.
8,561,683 B2 10/2013 Wood et al.
9,027,453 B2 5/2015 Ueda et al.
9,038,713 B1 5/2015 Bell et al.
9,284,824 B2 3/2016 Fadul et al.
10,000,994 B1 6/2018 Sites
10,151,180 B2 * 12/2018 Robey ..... E21B 43/117
10,443,361 B2 * 10/2019 Sites ..... F42B 1/02
2005/0211467 A1 9/2005 Ratanasirigulchia et al.
2007/0240599 A1 10/2007 Pratt et al.
2008/0121095 A1 5/2008 Han et al.
2010/0000397 A1 1/2010 Pratt et al.
2012/0160491 A1 6/2012 Goodman et al.
2013/0019770 A1 1/2013 Walker
2014/0034384 A1 2/2014 Fadul et al.
2017/0058649 A1 3/2017 Geerts et al.
2017/0138164 A1 5/2017 Mace et al.
2017/0145798 A1 * 5/2017 Robey ..... E21B 43/117
2017/0199015 A1 7/2017 Collins et al.

FOREIGN PATENT DOCUMENTS

GB 2548101 A 9/2017
WO 2008019173 A2 2/2008

* cited by examiner

HIGH SHOT DENSITY CHARGE HOLDER FOR PERFORATING GUN

CROSS-REFERENCE TO RELATED APPLICATIONS

This application is application is a national phase application of and claims priority to Patent Cooperation Treaty (PCT) Application No. PCT/EP2018/080298 filed Nov. 6, 2018, which claims priority to U.S. Provisional Application No. 62/585,125, filed Nov. 13, 2017, each of which is incorporated herein by reference in its entirety.

FIELD OF THE DISCLOSURE

The present disclosure is directed to a holder for shaped charges. Specifically, the present disclosure is directed to a high shot density shaped charge holder for use with a perforating gun.

BRIEF DESCRIPTION OF THE EXEMPLARY EMBODIMENTS

According to an aspect of the present invention, a shaped charge holder for a perforating gun comprises five or more shaped charges, each shaped charge having a detonation end and a firing end. One or more charge detonating cords is attached to the detonation end of the shaped charges, each charge detonating cord has a booster attached thereto. The shaped charges are arranged in a circular plane having a center with the detonation end and firing end of each shaped charge coaxially aligned, the detonation ends point toward the center of the circular plane and the firing ends point away from the center. A single main detonating cord is attached to each charge detonating cord with the booster between the main detonating cord and each charge detonating cord. The shaped charges are arranged such that the radial distance between each successive shaped charge holder is constant. The charge detonating cord may be arranged in a circle coplanar with the shaped charge circular plane and is attached to the detonation ends of every shaped charge.

According to another aspect, a shaped charge holder for a perforating gun generally includes a pair of opposed plates, each of which includes a plurality of indentations for receiving shaped charges in a coplanar, axially-oriented configuration. The shaped charge holder also includes at least one fastener for affixing the opposed plates to one another.

According to another aspect, each shaped charge within the holder is connected to its own detonating cord to enable a simultaneous initiation off all charges in one plane. The detonating cords might have a bi-directional booster at one end. The boosters or cords are connected to one another at a hub, which is connected to a single initiation explosive, like a main detonating cord, a single detonator or a single bi-directional booster charge. Since all detonating cords, which are connected to a shaped charge are connected at the same initiation explosive body, the shaped charges are detonated substantially simultaneously. This helps to reduce the cost and variability associated with assemblies that include multiple detonators connected to multiple detonating cords, such as those described in US Patent Application Publication No. US2017/058649.

BRIEF DESCRIPTION OF THE DRAWINGS

The following description will be made by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

DETAILED DESCRIPTION

Figure 1:
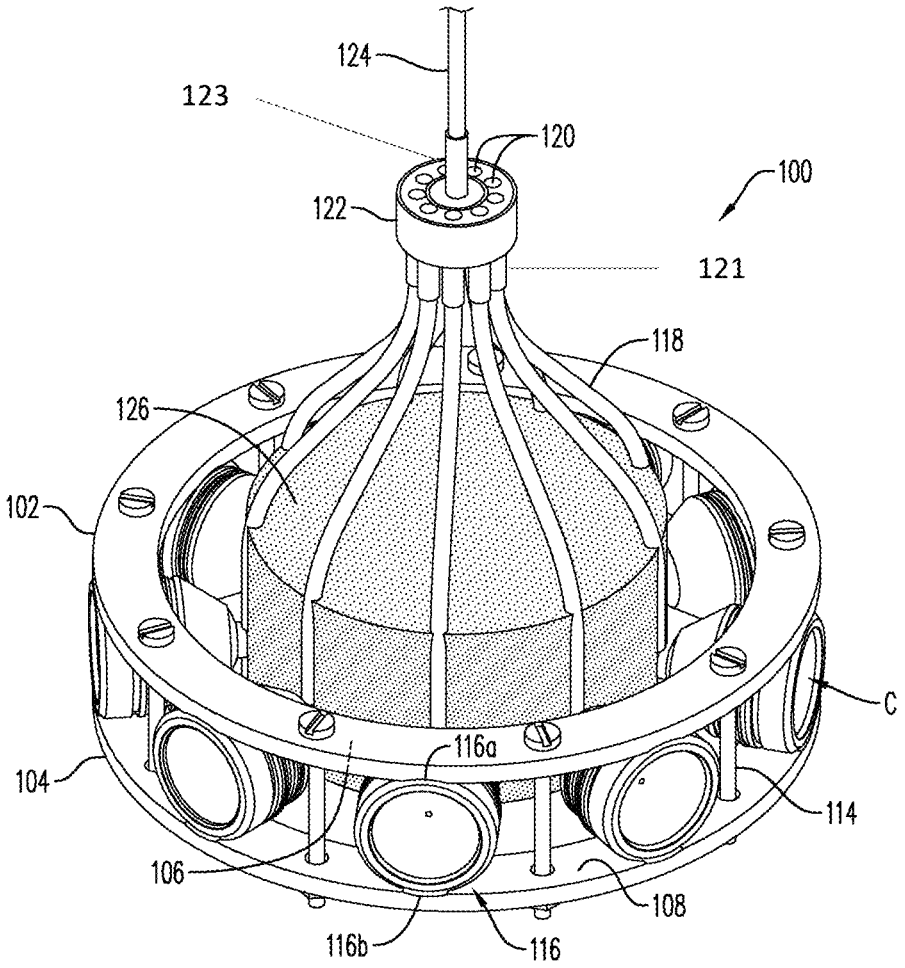
FIG. 1 is a perspective view of a shaped charge holder and a hub according to one aspect of the present disclosure, including nine shaped charges.

FIGS. 1-4 schematically illustrate a shaped charge holder 100 generally including a pair of disks or plates 102, 104 (e.g., a first plate 102 and a second plate 104) in a facing relationship with one another. Each plate 102, 104 has a respective interior side 106 (hidden from view), 108 (i.e., surface or face) and a respective exterior side 110, 112 (i.e., surface or face) opposite one another. In an embodiment, at least one of the plates 102, 104 may be an annular plate having an opening extending therethrough. The opening may receive a hub or detonating cord holder 122, as will be described in further detail hereinbelow.

Still viewing FIGS. 1-4, the shaped charge holder 100 is adapted to receive a plurality of shaped charges C (only one of which is labeled) between the plates 102, 104. When seated in the holder 100, the charges C generally face radially outwardly from a center of the holder 100, with the charges C all being in a coplanar configuration.

Figure 2:
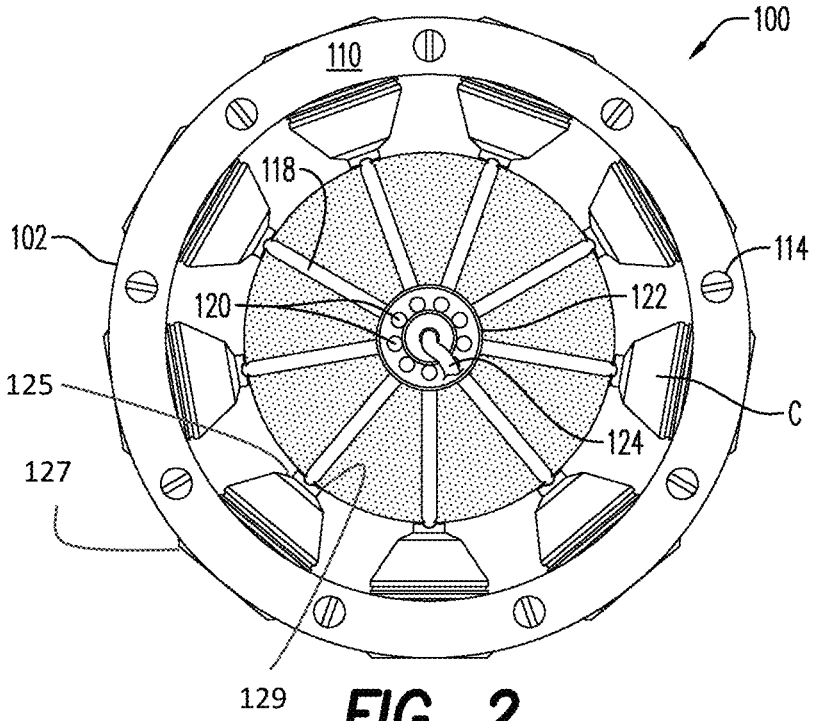
FIG. 2 is a top plan view of the shaped charge holder and the hub of FIG. 1, including the shaped charges.
Figure 3:
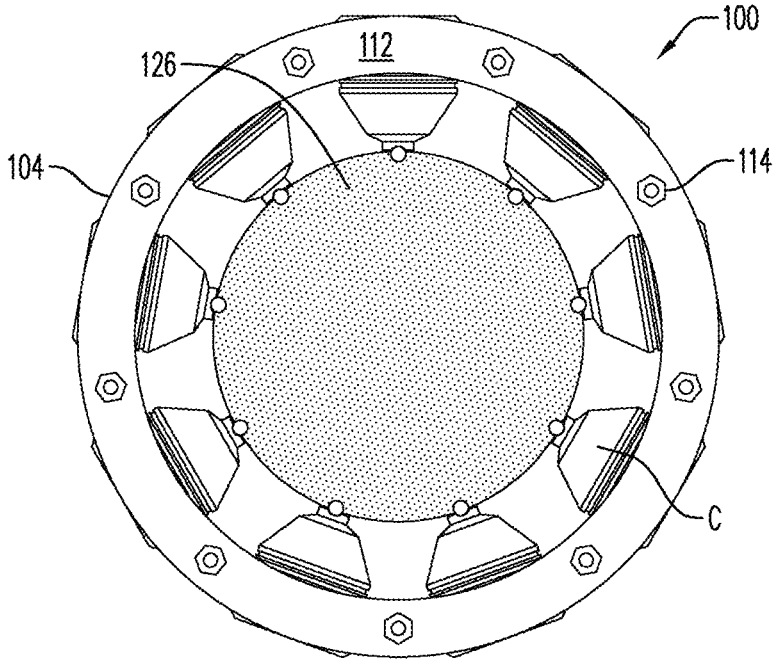
FIG. 3 is a bottom plan view of the shaped charge holder of FIG. 1, including the shaped charges.
Figure 7:
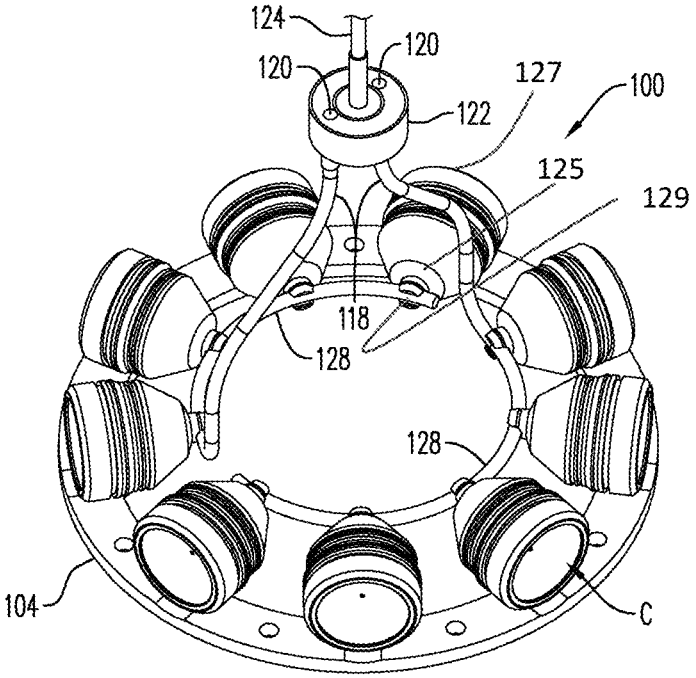
FIG. 7 is a perspective view of a shaped charge holder and a hub according to an alternative aspect of the present disclosure.
Figure 8:
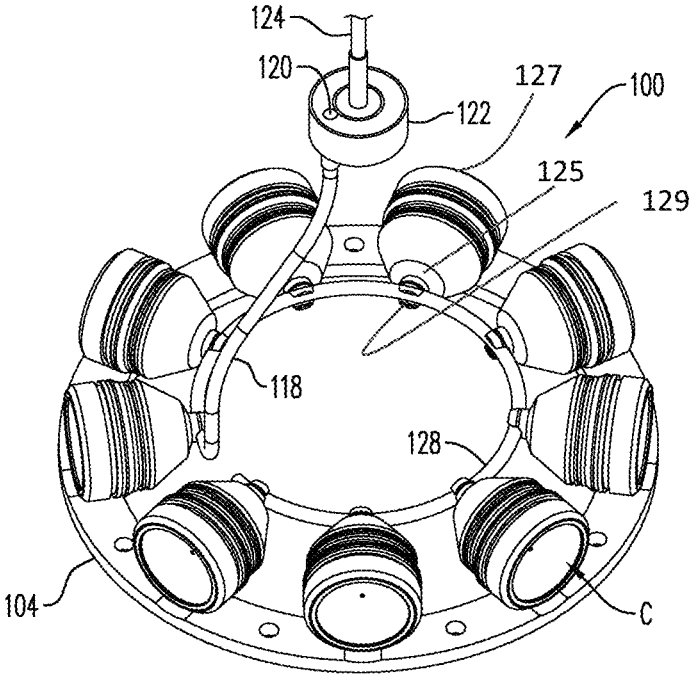
FIG. 8 is a perspective view of a shaped charge holder and a hub according to an alternative aspect of the present disclosure.

According to an aspect of the present invention, a shaped charge holder 100 for a perforating gun comprises five or more shaped charges C, each shaped charge having a detonation end 125 and a firing end 127, as shown in FIGS. 2, 7, and 8. Also, the detonation end 125 includes an initiation point 129. One or more charge or secondary detonating cords 118 is attached to the detonation end 125 of the shaped charges C, each charge or secondary detonating cord 118 has a booster 121 (e.g., bi-directional booster) attached thereto. The shaped charges C are arranged in a circular plane having a center with the detonation end 125 and firing end 127 of each shaped charge coaxially aligned, the detonation ends 125 point toward the center of the circular plane and the firing ends 127 point away from the center. A single or primary main detonating cord 124 is attached to each charge or secondary detonating cord 118 with a booster (e.g., receiver booster 123 or bi-directional booster 121) between the main or primary detonating cord 124 and each charge detonating cord 118. The shaped charges C are arranged such that the radial distance between each successive shaped charge holder 100 is constant. The charge or secondary detonating cord 118 may be arranged in a circle coplanar with the shaped charge circular plane and is attached to the detonation ends 125 of every shaped charge C.

The shaped charge holder 100 may include at least one fastener, or in this example, a plurality of fasteners 114 (only one of which is labeled), such as screws, for attaching the first and second plates 102, 104 to one another. The fasteners 114 may be tightened so that the interior side 106, 108 of each plate 102, 104 is urged tightly against the surface of the shaped charges C.

The interior side 106, 108 of each plate 102, 104 may also include a plurality of respective depressions or indentations 116*a*, 116*b* (hidden from view) (best seen in FIG. 4) for receiving the shaped charges C. Such depressions or indentations 116*a*, 116*b* may have a generally curved shape, and may be formed (e.g., milled or molded) to closely conform to the shape and/or contours of the exterior surface S of the shaped charges C. When the plates 102, 104 are configured in an opposed relationship with the depressions or indentations 116*a*, 116*b* in register with one another, each pair of depressions or indentations 116*a*, 116*b* collectively define a holder 116 for a shaped charge C.

As shown throughout the figures, each shaped charge C is connected to an individual or secondary detonating cord 118 (only one of which is labeled) at or near the initiation point 129. A free end 120 of each detonating cord 118 is connected to a booster 121 (e.g., bi-directional booster), which is received within a splitter or upper cord holder 122, which in turn, is connected to a main (i.e., initiation) explosive, such as at least one of a receiver booster 123, detonator and detonating cord 124. The main or primary detonating cord 124 is connected to a single detonator (not shown). When the detonator is activated, the shaped charges C are initiated substantially simultaneously (i.e., in a parallel sequence). Any suitable detonator may be used, for example, an RF safe detonator, resistorized detonator, or a receiver booster. The use of a single detonator helps to reduce the cost and undesirable variability associated with multi-detonator assemblies.

The shaped charge holder 100 may also include a spacer or separator 126 generally centrally located between the charges C. The spacer 126 may generally assist with maintaining the individual detonating cords 118 in a separated condition from one another. The spacer 126 also confines the cord at the end of the charge and avoids gaps between the cord and the backside of the shaped charge.

Countless variations are contemplated by the present disclosure. For example, the shaped charge holder may be configured to hold any number of charges desired, for example, 5, 6, 7, 8, or 9 charges. It is also contemplated that multiple shaped charge holders according to the present disclosure may be used in conjunction with one another.

Alternate detonator cord configurations and/or boosters may be included if desired. For example, instead of individual detonating cords 118 from the upper cord holder 122, a single detonating cord may be formed in a circle and connect to each shaped charge C along the periphery of the circle. FIG. 7 shows a configuration with two boosters 120, each attached to a detonating cord 118. Each of the two detonating cords 118 have a semi-circular section 128 that attaches at its periphery to multiple charges C. When the main detonating cord 124 detonates the two boosters 120, each booster 120 detonates the attached detonating cord 118. Each detonating cord 118 then detonates the shaped charges C to which it is attached, with a very slight delay between each detonation proceeding around the semi-circular section 128 of each detonating cord 118. Alternatively, each of the two detonating cords 118 need not be attached to neighboring shaped charges C. Rather, by way of example, the cords 118 may be attached to charges C displaced from one another by about 180° and then proceed in the same direction around the circle. Such an arrangement would prevent any single charge C from needing to withstand the simultaneous explosion of two immediately neighboring charges. In the same way, the circle can be divided into 3 or more sections, with each being accorded its own detonating cord 118 and booster 120.

FIG. 8 shows a configuration with a single booster 120 and detonating cord 118. The semi-circular section 128 of detonating cord 118 attaches to each of the nine charges C shown; the semi-circular section 128 in this configuration very nearly completes a complete circle. When the main detonating cord 124 detonates the booster 120, it detonates the attached detonating cord 118. The detonating cord 118 then detonates all of the shaped charges C, with a very slight delay between each detonation proceeding around the semi-circular section 128 of the detonating cord 118.

Figure 4:
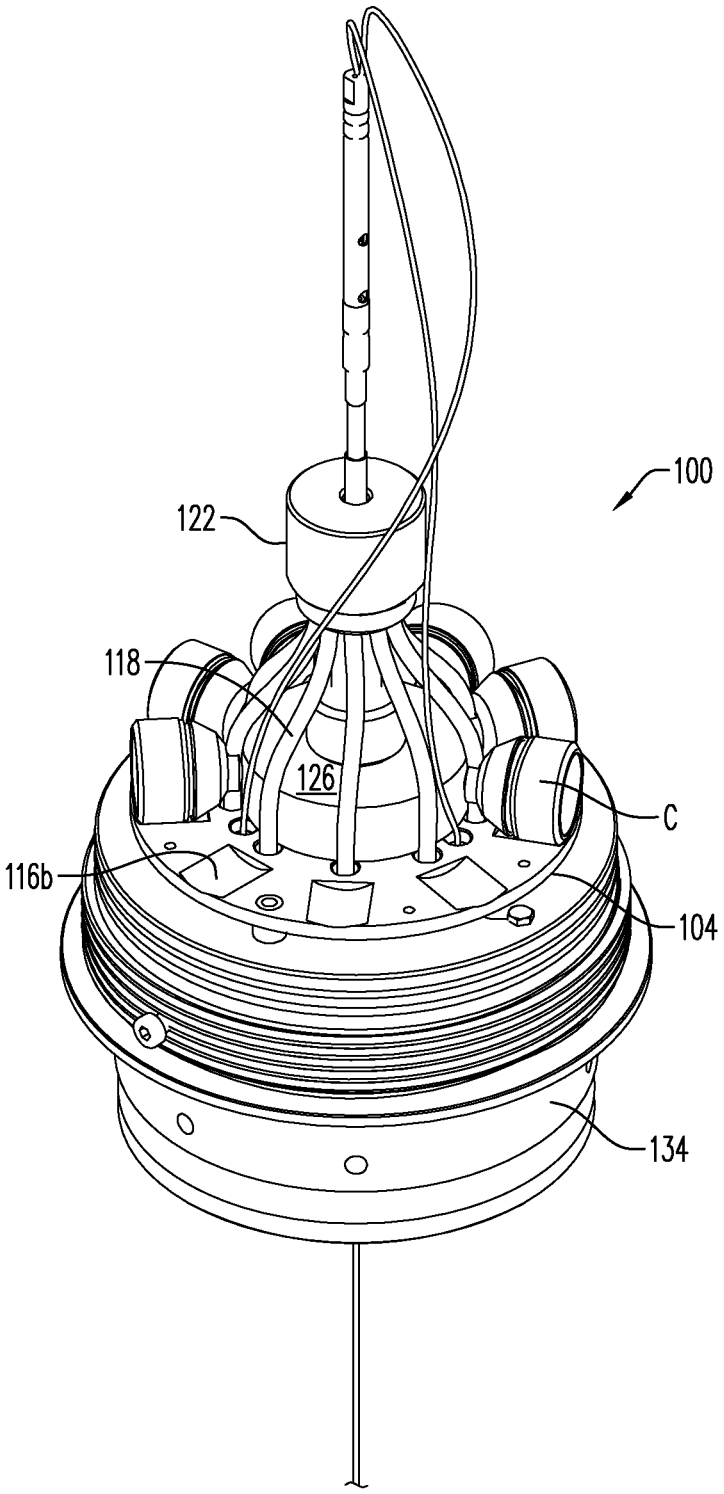
FIG. 4 is a perspective view of a shaped charge holder disposed in combination with a sub, including six shaped charges, with three charges not shown, according to an aspect.
Figure 5:
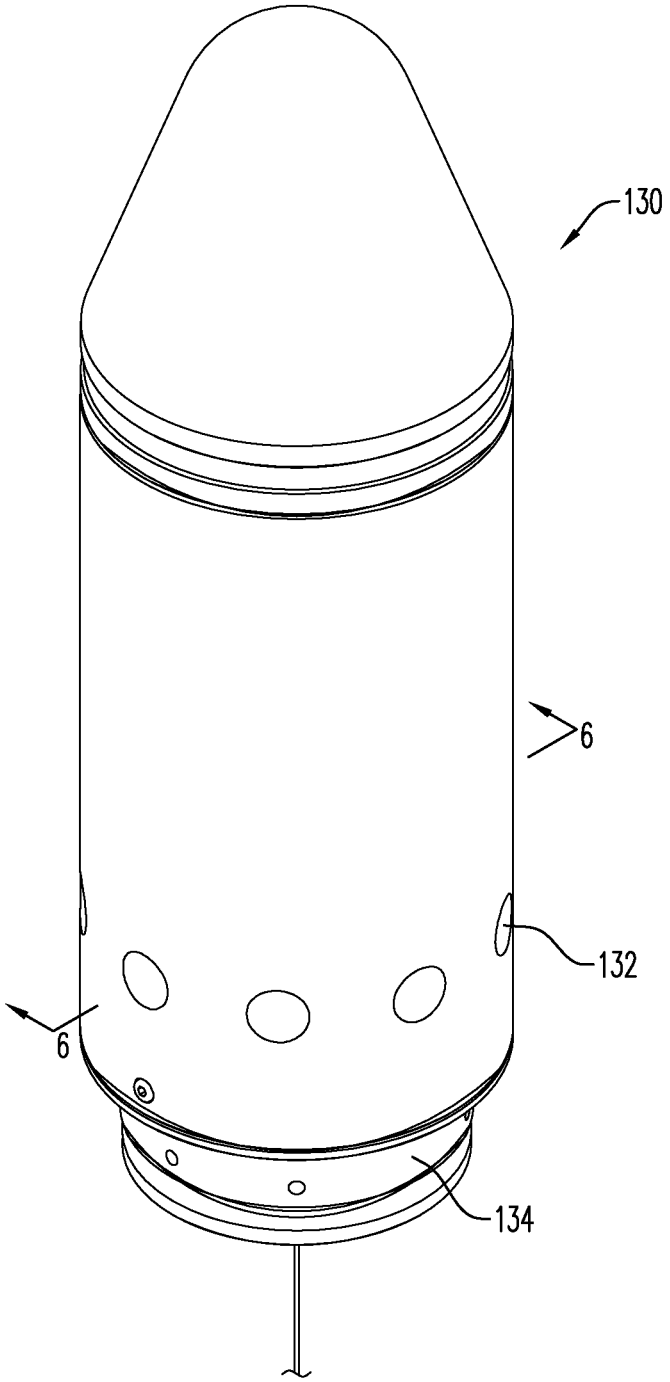
FIG. 5 is a perspective view of a perforating gun configured for housing a shaped charge holder, according to an aspect.
Figure 6:
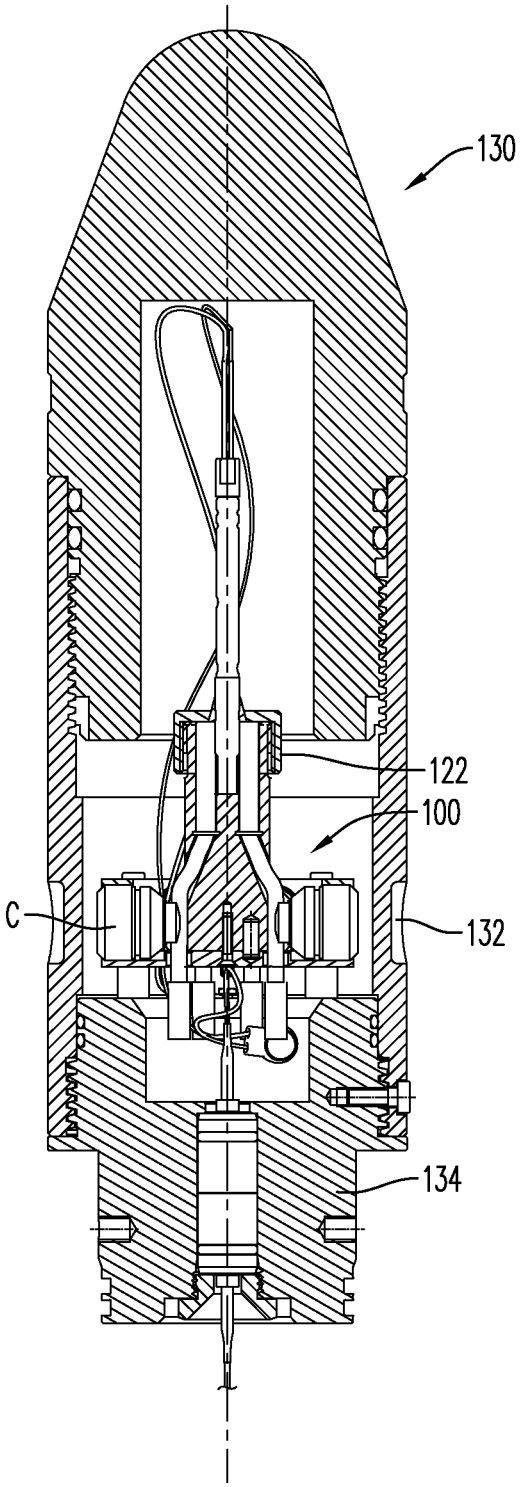
FIG. 6 is a cross-sectional side view of the perforating gun of FIG. 5 taken along line 6-6, the perforating gun having disposed within a shaped charge holder and hub according to the present disclosure.

FIG. 5 shows perforating gun 130 with sub 134 screwed into the base of the perforating gun 130. As seen in FIG. 4, shaped charge holder 100 is disposed on top of sub 134 and attached thereto. Perforating gun 130 may include scallops 132 opposite each shaped charge C. FIG. 6 illustrates a shaped charge holder 100 according to the present disclosure attached to sub 134 which is screwed into and becomes part of perforating gun 130. In this embodiment, one booster initiates the shaped charges C. The booster is connected to a detonating cord, and includes a detonator at its end.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of" Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A shaped charge holder for a perforating gun, the shaped charge holder comprising:

five or more shaped charges, wherein each shaped charge of the five or more shaped charges includes a detonation end and a firing end, wherein each shaped charge case of the five or more shaped charges is circumferentially spaced from an adjacent shaped charge, and is radially spaced with respect to a common central axis of the shaped charge holder, and each shaped charge of the five or more shaped charges is configured to form a separate perforating jet;

one or more secondary detonating cords attached to the detonation end of each shaped charge of the five or more shaped charges, each secondary detonating cord of the one or more secondary detonating cords having a booster attached thereto, wherein the shaped charges are arranged in a circular plane having a center, the detonation end and the firing end of each of the one or more shaped charges are coaxially aligned, the detonation ends point toward the center of the circular plane, and the firing ends point away from the center of the circular plane; and a single primary detonating cord, wherein the primary detonating cord is attached to each secondary detonating cord of the one or more secondary detonating cords and the booster of each secondary detonating cord of the one or more secondary detonating cords is positioned between the primary detonating cord and each secondary detonating cord of the one or more secondary detonating cords, wherein the primary detonating cord extends longitudinally, and wherein each shaped charge is radially and longitudinally spaced from the primary detonating cord.

2. The shaped charge holder of claim 1, wherein each shaped charge of the plurality of shaped charges is further arranged such that the radial distance between each successive shaped charge is constant.

3. The shaped charge holder of claim 1, wherein the one or more secondary detonating cords is arranged in a circle that is coplanar with the circular plane and each secondary detonating cord of the one or more secondary detonating cords is attached to the detonation ends of each shaped charge of the plurality of shaped charges.

4. The shaped charge holder of claim 1, wherein two or more secondary detonating cords each form a semicircle and are attached to two or more shaped charges at a semicircle periphery.

5. The shaped charge holder of claim 1, further comprising:

a first plate; and a second plate in an opposed relationship with the first plate, wherein the first plate is spaced apart from the second plate, and the first plate and the second plate each has an interior face and an exterior face, wherein the interior face of each of the first plate and the second plate includes a plurality of indentations shaped to receive the plurality of shaped charges between the first plate and the second plate.

6. The shaped charge holder of claim 5, wherein the plurality of shaped charges are positioned in a coplanar configuration within the shaped charge holder.

7. The shaped charge holder of claim 1, further comprising:

a pair of annular plates positioned opposite one another, each annular plate of the pair of annular plates having an interior surface and an exterior surface, wherein the interior face of the pair of annular plates includes a plurality of indentations shaped to receive the plurality of shaped charges; and a plurality of fasteners extend between and connect each annular plate of the pair of annular plates to one another with the plurality of shaped charges positioned therebetween.

8. The shaped charge holder of claim 7, wherein the shaped charges are radially arranged in a coplanar configuration between the pair of annular plates of the shaped charge holder.

9. A shaped charge holder assembly, comprising:

a plurality of shaped charges, each shaped charge of the plurality of shaped charges comprising a shaped charge case, and an explosive load positioned in the shaped charge case, wherein each shaped charge case of the plurality of shaped charges is angularly spaced apart from other shaped charge cases of the plurality of shaped charges, and each shaped charge is configured to form a separate perforating jet;

a pair of annular plates, wherein each annular plate of the pair of annular plates is positioned opposite one another and each annular plate of the pair of annular plates has an interior face and an exterior face, wherein the interior face of each annular plate of the pair of annular plates includes a plurality of indentations, wherein each indentation of the plurality of indentations is circumferentially spaced from an adjacent indentation and is radially spaced with respect to a common central axis, and further wherein each respective pair of indentations on the pair of annular plates is configured for receiving one shaped charge of the plurality of shaped charges;

one or more secondary detonating cords attached to each shaped charge of the plurality of shaped charges, each secondary detonating cord of the one or more secondary detonating cords having a booster attached thereto;

a detonator adjacent to each secondary detonating cord of the one or more secondary detonating cords in a side by side configuration, wherein the booster of each secondary detonating cord of the one or more secondary detonating cords is positioned between the detonator and each secondary detonating cord of the one or more secondary detonating cords, wherein the detonator extends longitudinally, and wherein each shaped charge is radially and longitudinally spaced from the detonator; and a plurality of fasteners extending between each annular plate of the pair of annular plates, wherein the plurality of fasteners is configured for securing the pair of annular plates to one another with the plurality of shaped charges positioned therebetween.

10. The shaped charge holder assembly of claim 9, wherein the one or more secondary detonating cords includes a plurality of individual secondary detonating cords of equal length, wherein each secondary detonating cord of the plurality of individual secondary detonating cords of equal length is connected to one shaped charge of the plurality of shaped charges.

11. The shaped charge holder assembly of claim 10, wherein each individual secondary detonating cord of the plurality of individual secondary detonating cords comprises a free end, and each free end is connected to one booster configured as a bi-directional booster configured to initiate each shaped charge of the plurality of shaped charges, and further wherein each bi-directional booster is positioned in a hub.

12. A shaped charge holder assembly, comprising:

a plurality of shaped charges, each shaped charge of the plurality of shaped charges having a shaped charge case including a curved outer surface, an explosive load positioned in the shaped charge case, and a liner positioned over the explosive load, wherein each shaped charge case of the plurality of shaped charges is angularly spaced apart from other shaped charge cases of the plurality of shaped charges and each shaped charge of the plurality of shaped charges is configured to form a separate perforating jet;

a pair of annular plates, wherein each annular plate of the pair of annular plates is positioned opposite one another and each annular plate of the pair of annular plates has inner face and an outer face, wherein the inner face of each annular plate of the pair of annular plates includes a plurality of inwardly curved depressions, wherein each inwardly curved depression of the plurality of inwardly curved depressions is circumferentially spaced from an adjacent inwardly curved depression and is radially spaced with respect to a common central axis, and further wherein each inwardly curved depression is shaped to accommodate the curved outer surface of each shaped charge of the plurality of shaped charges;

one or more secondary detonating cords attached to each shaped charge of the plurality of shaped charges, each secondary detonating cord of the one or more secondary detonating cords having a booster attached thereto;

a primary detonating cord, wherein the primary detonating cord is attached to each secondary detonating cord of the one or more secondary detonating cords and the booster of each secondary detonating cord of the one or more secondary detonating cords is positioned between the primary detonating cord and each secondary detonating cord of the one or more secondary detonating cords, wherein the primary detonating cord extends longitudinally, and wherein each shaped charge is radially and longitudinally spaced from the primary detonating cord; and a plurality of fasteners extending between each annular plate of the pair of annular plates, wherein the plurality of fasteners is configured for securing the pair of annular plates to one another with the plurality of shaped charges positioned therebetween.

13. The shaped charge holder assembly of claim 12, wherein the plurality of shaped charges is positioned between the pair of the annular plates so that the plurality of shaped charges face radially outward from a center of the charge holder in a coplanar configuration.

14. The shaped charge holder assembly of claim 13, wherein the one or more secondary detonating cords includes a plurality of secondary detonating cords of equal length, each secondary detonating cord of the plurality of secondary detonating cords of equal length being connected to one shaped charge of the plurality of shaped charges.

15. The shaped charge holder assembly of claim 14, further comprising a hub spaced radially and longitudinally from the plurality of shaped charges.

16. The shaped charge holder assembly of claim 15, wherein the primary detonating cord extends from the hub.

17. The shaped charge holder assembly of claim 16, wherein each individual secondary detonating cord of the plurality of individual secondary detonating cords comprises a free end, and each free end is connected to one booster configured as a bi-directional booster configured to initiate each shaped charge.

18. The shaped charge holder assembly of claim 17, wherein the bi-directional booster is positioned in the hub.

19. The shaped charge holder assembly of claim 18, further comprising a receiver booster positioned in the hub, wherein the receiver booster is communicably connected to the bi-directional booster, and the receiver booster is coupled to the primary detonating cord.

20. The shaped charge holder assembly of claim 16, further comprising a detonator coupled to the primary detonating cord.

* * * * *